US007707692B2

(12) United States Patent
Thomas et al.

(10) Patent No.: US 7,707,692 B2
(45) Date of Patent: May 4, 2010

(54) CONTROL SYSTEM FOR ROLLER GIN

(75) Inventors: Joe Thomas, Richmond Hill, GA (US); William D. Beeland, Savannah, GA (US)

(73) Assignee: Lummus Corporation, Savannah, GA (US)

( * ) Notice: Subject to any disclaimer, the term of this patent is extended or adjusted under 35 U.S.C. 154(b) by 0 days.

(21) Appl. No.: 12/115,181

(22) Filed: May 5, 2008

(65) Prior Publication Data

US 2009/0271952 A1 Nov. 5, 2009

(51) Int. Cl.
*D01B 1/04* (2006.01)

(52) U.S. Cl. ..... 19/48 R; 19/50; 19/54

(58) Field of Classification Search ..... 19/50–54, 19/48 R

See application file for complete search history.

(56) References Cited

U.S. PATENT DOCUMENTS

| | | | | |
|---|---|---|---|---|
| 4,563,794 | A * | 1/1986 | Beeland | 19/48 R |
| 4,771,665 | A * | 9/1988 | Van Doorn et al. | 83/62.1 |
| 6,263,545 | B1 * | 7/2001 | Pinto | 19/97.5 |
| 6,460,223 | B1 * | 10/2002 | Pinto | 19/105 |
| 2007/0163087 | A1 * | 7/2007 | Pinto | 19/105 |

* cited by examiner

*Primary Examiner*—Shaun R Hurley
(74) *Attorney, Agent, or Firm*—Smith, Gambrell & Russell

(57) ABSTRACT

A system for controlling the feed rate of seed cotton to a roller gin utilizes a plurality of sensors to measure gin roll temperature, power requirements, seed cotton accumulation on the gin roll and/or ginned seed reflectance to dynamically vary feed rate, rotary knife speed and gin roll speed, force and position against stationary knife to increase ginning efficiency.

7 Claims, 1 Drawing Sheet

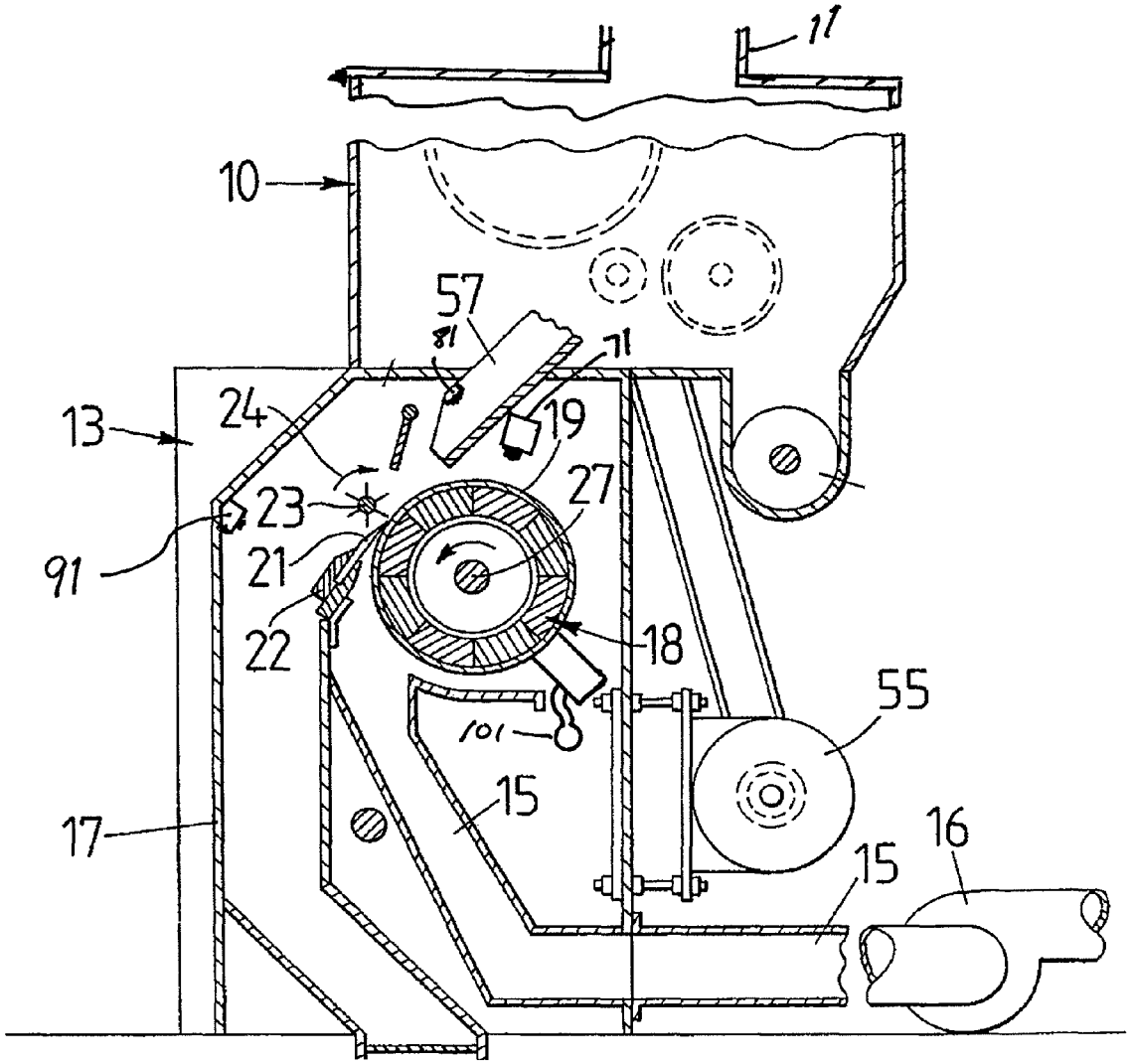
11
10
57
81
71
13
24
19
23
27
91
21
22
18
55
101
15
17
15
16

CONTROL SYSTEM FOR ROLLER GIN

BACKGROUND

In the field of cotton ginning, there are two major systems currently used: saw ginning and roller ginning. Saw ginning is by far the most commonly used system because of its much higher capacity also termed rate of processing. Roller ginning on the other hand has been a much slower process and therefore more expensive, but, it is less aggressive than the saw ginning process and therefore better preserves the fiber staple length and produces fewer "neps" which are tiny entanglements of the fibers. Laboratory tests have proven that the roller ginning process may be dramatically increased in processing rate making it much more competitive with saw ginning cost-wise. This combination of the more economical high capacity ginning and the superior fiber quality of roller ginning is making roller ginning the method of choice for raw cotton markets desiring high quality fiber. While the recently proven much higher roller ginning rates are feasible, these ginning rates cannot always be maintained on all cotton varieties (cultivars) and all incoming seed cotton conditions. There are some varieties that do not lend themselves to the high capacity roller ginning process and will choke the gins at the highest feed rates into the gins. Merely reducing the rate of feed of these seed cottons to the gins results in overheating of the ginning roller. This overheating has serious consequences such as shortened ginning roller cover packing life, and in extreme cases complete destruction of the ginning surface of the packing roller.

SUMMARY OF THE INVENTION

It is an object of the present invention to provide remedies to allow roller ginning of various cultivars with apparatus that adjust the speeds of the critical revolving components of the roller gin and the force pressing the gin roll against the stationary knife to optimize the ginning rates of the respective varieties and conditions of cotton. It is a further object of this invention to automatically adjust the speeds of the critical revolving components with the use of sensors indicating the need for changing the speeds and contact force of these components. It is a further object of the current invention that the sensors used to indicate the need for changing the speeds of the critical rotating components include as needed: heat sensors, load sensors on the rotating components, pressure sensors on the gin roll relative to the stationary knife, rotational speed sensors, or sensors indicating the presence or absence of matter in a selected space. A still further object of the current invention is to optimize the ginning rate for each seed cotton condition through algorithms employing various combinations of inputs from the above mentioned sensors and monitors.

BRIEF DESCRIPTION OF THE DRAWINGS

The Figures illustrate a typical roller gin having a plurality of sensors strategically located to monitor the operational conditions in the gin.

DESCRIPTION OF A PREFERRED EMBODIMENT

Current roller gins include three vital elements: a ginning roller covered with fibrous material, a stationary knife pressed against the ginning roller surface with considerable pressure, and a rotary knife about two and three-quarters inches in diameter having up to six radial blades equally spaced from each other. Seed cotton is dropped onto the surface of the rotating ginning roller, which carries the cotton to the stationary knife drawing the fibers under the edge of the knife. The knife edge strips back the seeds thus pulling the fibers from the seed. As the seeds accumulate on the edge of the stationary knife, the blades of the rotary knife periodically sweep the seeds away from the stationary knife.

Referring now to the Figure for a better understanding of our invention, as stated, we will describe the same in association with a more or less standard roller gin feeder combination. Thus, at 10 we show a seed cotton feeder to which seed cotton is delivered from a conveyor-distributor, not shown, through a chute indicated at 11. The feeder 10 delivers the cotton to be ginned to a roller gin indicated generally by the numeral 13 on shaft 27 via slide 57 and guide 26. Trash removed in feeder 10 is carried away by conveyor 51. A suitable conveyor is located beneath the gin to carry away seed. The lint removed from the seed is discharged from the back of the gin through a lint flue 15 having a suction fan 16 connected thereto.

Referring to the Figure it will be understood that the gin embodies the usual framework or box-like enclosure 17. Mounted in the gin 13 on shaft 27 is a driven ginning roll 18 the outer surface of which is covered with a fibrous material 19 as is understood in the art. The ginning or stationary knife is indicated at 21 and is mounted on relatively heavy supporting framework 22 which spans the gin from end to end so that the knife 21 is coextensive in length with the roll 18. Roll 18 may be driven by a motor connected by appropriate belts and sheaves as is well known in the art. At 23 we show what is known in the trade as a rotary knife and which is driven in the direction of arrow 24 by a motor. The rotary knife 23 also is substantially the length of the roller 18 and stationary knife 21.

As noted above, a substantial problem exists in the art relative to cotton varieties and conditions that do not lend themselves well to the high capacity roller ginning process and the known solutions create overheating problems along the roll 18. As seen in FIG. 1, lint cotton is carried on the surface 19 past the stationary knife 21 and exits through conduit 15, such that the roll surface 19 is substantially free of lint cotton as it traverses the arc from conduit 15 to the feeder slide 57. In this region we have placed a sensor 71 which is designed to determine the temperature of the surface 19 of ginning roll 18. Sensor 71 is preferentially a non contact sensor designed to monitor and note the spectral emissivity of the surface 19 to determine whether the roll is within the proper temperature regimen. Alternatively, an internal sensor, built into ginning roll 18, could be used. Sensor 71 may be a set of sensors spaced along the length of roll 18 and offset from the roll at a distance such that each adjacent sensor overlaps marginally with the sensors on either side thereof or it may be a traversing sensor or sensors that travel the length of the roll 18. It will be appreciated that sensor 71 may be selected from the available categories of thermal based bolometers, thermocouples or thermopiles, and pyrometers or pyroelectric, and optical pyrometers. Electrical output options for infrared temperature sensors include analog current, analog voltage, analog frequency, serial, parallel, other digital, and switch or alarm. In either event sensor 71 should have output to a control logic 77 which can initiate an alarm to an operator at a selected temperature threshold and can initiate shutdown of the gin if necessary. However, the goal of the invention is not to present an alarm or shut down but rather generate an electric signal, which corresponds to a particular condition or temperature to control the gin parameters to avoid high temperatures and take corrective measures when high temperature changes are encountered due to changes in the seed cotton, extraneous matter, or fiber presented for ginning.

It is to be understood that the speed of roller 18 and rotary knife 23 are important factors in the efficiency of ginning cotton and that the speed of these elements should be varied as a function of the rate of feed of the seed cotton through the feeder 10 to the gin. When difficult to gin cultivars are introduced to the gin, the feed rate will likely become too high and the roll 18 and rotary knife 23 will not efficiently gin the seed in which case the seed cotton may accumulate on slide 57 and the seed exiting over knife 21 will contain excess fiber. Additionally, the power required to turn the ginning roll and rotary knife will increase. Accordingly, sensors 18*s* and 23*s* are connected to the motors or to the drive system to measure the load on the gin roll motor or rotary knife motor. Sensors 18*s* and 23*s* may be wattage or torque transducers. Where the roll and rotary knife are driven by the same motor 55, utilizing different gearing or belting outputs, then the load may be measured on the single power source. Further, sensor 23*s* may be configured to measure the power required to drive rotary knife 23. As with temperature sensor 71, the output of sensors 18*s* and 23*s* are input to control logic 77, which may be resident in a PC or other industrial programmable controller, and may be used to generate control signals controlling the rate of feed of the feeder 10, the speed of the roll 18, or the speed of rotary knife 23. That is to say, varying power requirements may be used to indicate less than optimal operation of the gin, necessitating changes in the feed rate of cotton to the gin and/or changes of the speed of the roll and/or rotary knife.

In addition to temperature and power measurements, the efficiency of the gin with various cultivars and conditions may be indicated by the accumulation or lack thereof of seed cotton on roll 18 up stream of the rotary knife 23. Accordingly sensor 81 is positioned upstream to detect the quantity of seed cotton accumulated on the roll awaiting ginning. Sensor 81 may be selected from the available categories of photocells. Variations from the optimum quantity are output to control logic 77 which again controls the feed rate of feeder 10 and the speed of roll 18 and rotary knife 23. Further, the efficiency of the gin may be indicated by the quantity of fiber left on the seed after it passes the stationary knife and is released from the roll 18 and rotary knife 23. This value can be determined by a sensor 91 positioned downstream of the stationary knife and in position to measure the reflectivity of the cotton seed. A suitable sensor can be selected from the categories of retro-reflective photocells. If excessive fiber remains on the seed then the speed of roller 18 and/or rotary knife 23 can be adjusted which requires a commensurate adjustment of the rate of feeder 10, thus sensor 91 must also have an output to control logic 77.

Still another factor affecting the efficiency of the roller gin is the force pressing the ginning roll against the stationary knife which is exerted by air cylinders on each gin roll end journal which supports roller shaft 27. Excessive force produces overheating of the gin roll. Inadequate force allows slippage of fibers between gin Roll and stationary knife and loss of ginning rate. Accordingly, pressure sensors 101 are mounted in the compressed air lines adjacent the air cylinders. The pressure signals are output to control logic 77 which may combine the pressure signals with the signals from the other sensors 18*s*, 23*s*, 81 and or 91 to modulate the speed of roller 18 and/or knife 23 and feed rate from feeder 10. Control logic 77 may also modulate the pressure output of the compressed air regulators at said air cylinders.

The rate of speed of the feeder 10 may be linear or may be computed from a non linear mathematical formula contained in software in control logic 77 using one or more of the values provided by sensors 18*s*, 23*s*, 77, 81, 91, or 101. Specifically, the formula depends on the interaction of the signals from the sensor or sensors employed relative to the respective components to optimize the ginning rate for each condition of seed cotton being processed while avoiding the risk of damage to the gin roll or stoppages. Exemplary formulas showing the relationship between gin roll speed in rpm (GRS), gin roll temperature (GRT), and feed rate as a percentage of maximum rate (FR) are as follows and are based on operating the roll at 400 rpm or lower.

$$FR\ \%=(GRS/4)-25 \text{ where } 200<GRS<400 \text{ and } FR\&GRS=O@GRS<200$$

$$GRS=400-(GRT-225)\times 16 \text{ where } GRT>225$$

And FR %=0.25[400−(GRT−225)×16], thus at a sensed temperature of 240 degrees F., the Feed rate would be:

FR %=0.25[400−(240−225)×16]=160.@ GRS<200,FR=0. Note−@ GRS<200 RPM,GRS also drops to 0 RPM and switch on roller gin actuates air cylinders on gin roll to back away gin roll from stationary knife.

While the invention has been described generally, it is to be understood that various combinations of sensors and control algorithms may be employed without departing from the scope of the appended claims.

The invention claimed is:

1. In a roller gin, containing a ginning roller and a rotary knife rotationally driven by at least one motor, into which seed cotton is fed by a driven seed cotton feeder at variable feed rates, control logic for said driven seed cotton feeder and at least one motor in which said control logic varies the rotational speed of the ginning roller or the ginning roller and the rotary knife in proportion to the rate of feed of said feeder, responsive to one or more sensors operatively positioned in said roller gin to detect one or more conditions in said system critical to the proper functioning of said system, said one or more conditions selected from the conditions including gin roll temperature, gin roll speed, feed rate, seed cotton accumulation at the ginning roller, power required for ginning, and remaining lint on processed cotton seeds, the signals from said sensors employed by said control logic to modulate the rotational speeds of the ginning roller or rotary knife and/or said feed rate of seed cotton to the system, whereby the efficiency of the roller gin is maintained over a defined gin roller speed and feed rate.

2. In a roller ginning system as described in claim 1 in which the ratios of the ginning roller and/or ginning roller and rotary knife relative to the seed cotton feed rate are non-linear but vary in response to a mathematical formula selected from formulas including FR %=(GRS/4)−25 where 200<GRS<400 and FR&GRS=O@GRS<200, and GRS=400−(GRT−225)×16 where GRT>225, FR is feed rate, GRS is gin roller speed and GRT is Gin Roller Temperature.

3. In a roller gin system as described in claim 1 in which one of said sensors is a heat sensor that detects the temperature of said gin roller, said heat sensor having an input to said control logic and said control logic modulating said feed rate and gin roller speed to maintain said temperature.

4. A roller ginning system as described in claim 1 in which one of said sensors is a sensor that determines the presence or absence of seed cotton accumulation at a fixed distance from an entry side of said rotary knife.

5. A roller ginning system as described in claim 1 in which one of said sensors is a sensor to determine the power required to drive said rotary knife.

6. In a roller ginning system as described in claim 1 in which one of said sensors is a sensor located on a discharge side of the rotary knife which senses the degree of light reflectance of the seed being discharged from the rotary knife to determine the degree of fiber remaining on the discharged seed, said sensor having an output to said control logic whereby the speed of said gin roll and feeder are adjusted to improve the efficiency of said roller ginning system.

7. In a roller gin containing a driven ginning roller, a stationary knife and a driven rotary knife proximal to a variable speed seed cotton feeder supplying seed cotton at variable rates to said roller gin, said ginning roller and rotary knife rotationally driven by electrical variable speed means, control means in communication with said variable speed feeder and said ginning roller and rotary knife to vary the rotational speed of the ginning roller and rotary knife as the feed rate varies throughout at least a portion of the full range of feed rates, thus to maintain a substantially uniform layer of seed cotton on said ginning roller surface throughout said portion of feed rates to reduce the frictional heat between said ginning roller and said stationary knife as said feed rate varies.

* * * * *